US008167005B2

(12) United States Patent
Lingenhoff

(10) Patent No.: US 8,167,005 B2
(45) Date of Patent: May 1, 2012

(54) MACHINE FOR FILLING CUPS WITH FOODSTUFF

(75) Inventor: Berthold Lingenhoff, Ahaus (DE)

(73) Assignee: Finnah Packtec GmbH, Ahaus (DE)

( * ) Notice: Subject to any disclaimer, the term of this patent is extended or adjusted under 35 U.S.C. 154(b) by 1326 days.

(21) Appl. No.: 11/696,207

(22) Filed: Apr. 4, 2007

(65) Prior Publication Data

US 2007/0235104 A1 Oct. 11, 2007

(30) Foreign Application Priority Data

Apr. 4, 2006 (DE) ..... 10 2006 015 638

(51) Int. Cl.
*B65B 1/04* (2006.01)

(52) U.S. Cl. ..... 141/237; 141/103; 141/156; 141/234; 141/284

(58) Field of Classification Search ..... 141/100–105, 141/144–147, 156–162, 179, 186, 234–238, 141/266, 279, 284
See application file for complete search history.

(56) References Cited

U.S. PATENT DOCUMENTS

| | | | | |
|---|---|---|---|---|
| 3,559,700 | A | 2/1971 | Erickson | |
| 3,695,486 | A * | 10/1972 | Warner | 222/162 |
| 3,817,300 | A * | 6/1974 | Donnet | 141/117 |
| 4,000,765 | A * | 1/1977 | Lydiksen | 141/181 |
| 4,151,698 | A | 5/1979 | Muller et al. | |
| 4,375,826 | A | 3/1983 | Stohlquist et al. | |
| 4,730,648 | A * | 3/1988 | Walter | 141/91 |
| 4,871,001 | A * | 10/1989 | Nobuta et al. | 141/279 |
| 4,942,910 | A * | 7/1990 | Hamamura | 141/9 |
| 4,964,545 | A * | 10/1990 | Mooshammer | 222/271 |
| 5,095,955 | A | 3/1992 | Barnewitz et al. | |
| 5,309,955 | A * | 5/1994 | Torterotot | 141/1 |
| 5,529,099 | A * | 6/1996 | Janek et al. | 141/129 |
| 5,687,779 | A | 11/1997 | Andersson et al. | |
| 5,966,897 | A * | 10/1999 | Kirka et al. | 53/55 |
| 5,996,652 | A * | 12/1999 | Schromm | 141/172 |
| 6,063,419 | A | 5/2000 | Roche et al. | |
| 6,209,591 | B1 * | 4/2001 | Taggart | 141/89 |
| 6,715,518 | B2 * | 4/2004 | Finkowski et al. | 141/129 |
| 6,715,519 | B1 | 4/2004 | Battaglia | |
| 6,941,985 | B2 * | 9/2005 | Kondo et al. | 141/276 |
| 6,964,285 | B1 | 11/2005 | Battaglia | |
| 7,108,024 | B2 * | 9/2006 | Navarro | 141/127 |

FOREIGN PATENT DOCUMENTS

| | | | |
|---|---|---|---|
| DE | 295 12 257 | U1 | 10/1995 |
| DE | 197 35 621 | C2 | 2/1999 |
| DE | 197 58 543 | A1 | 6/1999 |
| EP | 1 602 579 | A1 | 12/2005 |
| FR | 2 149 681 | A | 3/1973 |
| FR | 2 708 563 | A1 | 2/1995 |
| WO | 01/83304 | A | 11/2001 |

* cited by examiner

*Primary Examiner* — Timothy L Maust
(74) *Attorney, Agent, or Firm* — Gudrun E. Huckett

(57) ABSTRACT

A machine for filling cups with foodstuff has metering stations having metering modules provided with filling nozzles, respectively, for introducing product flows into horizontally supplied cups. A programmable control unit cooperates with the metering modules in such a way that in a filling process, by means of controlled tilting and/or lifting actions of the filling nozzles, variable filling structures are generated from the product flows in the cups.

8 Claims, 6 Drawing Sheets

MACHINE FOR FILLING CUPS WITH FOODSTUFF

BACKGROUND OF THE INVENTION

The invention relates to a machine for filling cups with foodstuff. The machine introduces at least two product flows in the area of metering stations by means of their filling nozzles, respectively, into the supplied cups, wherein in the area of at least one metering module comprising the filling nozzle a controlled filling process can be performed.

Known machines for filling cups are provided with constructions in the form of cup filling devices (DE 29512 257 U1; DE 197 35 621 C2; DE 197 58 543 A1) wherein a cup supplied to be filled can be filled selectively with two different product flows by means of filling nozzles in the form of a twin filling tube. In the area of the metering stations, only one cup support in the form of a lifting plate can be used for the filling process which cup support is preadjusted by guide parts to perform tilting and/or lifting movements. The lifting plate is moved with the empty cup into an upper position toward the multi-metering device that itself is stationary. According to U.S. Pat. No. 4,151,698 the cups are supplied sequentially to a pre-metering device and a main metering device so that a fruit paste and yogurt can be introduced on top one another into the cup.

U.S. Pat. No. 6,964,285 B1 discloses filling of cups with pasty foodstuff wherein only the quantity to be filled in can be delivered by program control by means of nozzles interacting with servo motors, wherein the quantity to be filled in is conveyed at high speed into the cups moveable into a position underneath the nozzles. In EP 1 602 579 A1 the cups are lifted toward a nozzle arrangement and rotated when lowered so that for distribution of the product a complex cup support is required. In a filling process according to FR 2 708 563 A1, nozzles having several channels are utilized at a metering station, respectively, and in a cup filling process according to U.S. Pat. No. 5,095,955 a product is optimally distributed in the interior of the cup by moving the cup.

SUMMARY OF THE INVENTION

It is an object of the present invention to modify an essentially known machine for filling cups wherein, by means of minimal control expenditure, a quantity-variable and layer-variable control and distribution of product flows into the cups is to be achieved, wherein the cups are supplied in a simple way, and wherein also interruption-free filling phases are possible substantially without retrofitting costs for a change of compositions.

In accordance with the present invention, this is achieved in that the machine is provided with a programmable control unit that interacts with the metering modules in such a way that in the horizontally supplied cups substantially variable filling structure can be generated solely by means of controlled tilting and/or lifting movements of the filling nozzles.

Preferably, the cups positionable in a timed sequence are moved to several metering stations of the machine and the different product flows, respectively, are introduced into the momentarily stationary cups.

Advantageously, the variable filling structures in the cups are affected by a computer correlated with the control unit.

On the machine, by means of changeable program data of the computer, product supply/supplies and/or filling nozzle movements in the area of at least one of the metering modules are controlled.

On the metering stations, sequentially two or more product flows are introduced into a cup and, when doing so, the different filling structures are generated by means of predetermined program data, respectively.

On the machine, without interruption of the filling process, sequentially supplied or parallel supplied cups can be filled with changing filling structures.

During operation of the machine, the control unit is adjustable by changeable program data in the area of the computer.

The control unit affecting the filling structure is connected to three metering stations and at least four filling heads of the metering modules, which filling heads are connected to form a row by at least four supply lines, are controllable.

The machine configured in accordance with the invention interacts in the area of its filling and movement modules provided for the filling process with a programmable control unit that, with simple means, enables a substantially variable generation of decorative and visually pleasing filling structures in the cups. The cups that are positionable in a timed sequence are moved within the machine, carrying out an essentially known filling process, to one or several metering stations. At the metering stations, product flows that can have different consistency are then delivered by means of the programmable control unit in accordance with the filling nozzle movements preset by the control unit into the stationary cups such that, in accordance with the programmed tilting and lifting movements as well as the product quantity, the filling structures generated within the cup can be varied.

With this filling concept, a variety of filling structures, not possible in known machines, can be simply planned, preset in the program of the control unit, and varied by means of the filling nozzle control without requiring additional movement of the cups in the filling phase. With this machine concept improved according to the invention the filling process is matched to customer-specific variable cup configurations. The foodstuff can be combined, optimally presented and provided in an advertising-effective way as a structured cup filling.

The variable filling structures in the cups that are comprised in particular of transparent material are generated by a computer connected to the machine control unit by means of which, by simple changes of program data, the distribution of several product flows, in particular differing in regard to color, from the filling nozzles can be controlled. The product flows are combined in particular as they rise from the cup bottom to create decorative color combinations. In accordance with the computer program, the products can also be introduced sequentially at several metering stations into the cups that are stationary in each filling phase, and geometric designs can become visible in a variable diversity. Conceivable are in this connection, in addition to multi-color horizontal layers, primarily dots, helical, vertically stepped, conical or similar structures or structure combinations. In this connection, the provided control concept of the machine is simplified in that control movements, e.g. by means of servo motors, are required only in the area of the metering modules while the cups are horizontally moved in a timed sequence to the metering modules. The holding and guiding component groups of known filling systems required usually for the vertical movement of the cups are therefore not needed because, according to the invention, the combination of vertical filling nozzle movements, rotation of the filling nozzles, and phase-wise introduction of the product flow is used; therefore, the technical expenditure is significantly reduced.

DESCRIPTION OF THE PREFERRED EMBODIMENTS

Figure 1:
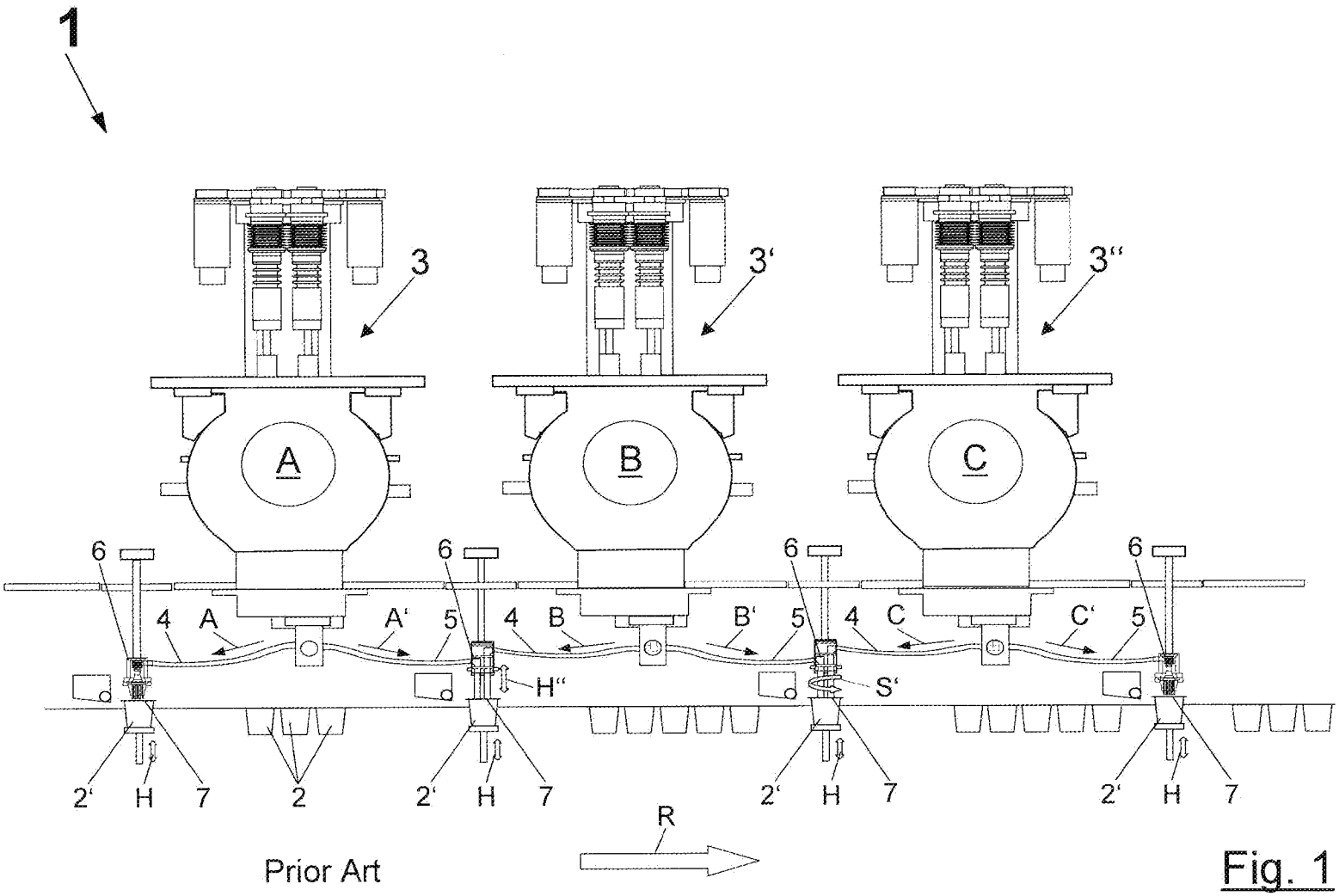
Fig. 1 Prior Art
FIG. 1 is a basic illustration of a machine of the prior art configuration for filling cups.

FIG. 1 shows a basic illustration of a machine for filling cups 2, the machine referenced as a whole by reference numeral 1. In the area of the metering stations 3, 3', 3", foodstuff is introduced into the cups. In the illustrated embodiment the prior art machine 1 has three metering stations arranged sequentially in the advancing direction R of the cups 2 wherein also embodiments with a different number of metering stations are conceivable and in the transverse direction several metering stations can be arranged adjacent to one another (not illustrated). The metering stations 3, 3', 3" have at their exit side supply lines 4, 5, respectively, that enable the introduction of product flows (arrows A, A'; B, B'; C, C') into the supplied cups 2" by means of the filling nozzle 7, respectively, in the area of each metering module 6. This prior art machine 1 with filling nozzles 7 is equipped with filling devices of the type of a mechanically controlled revolving head so that for a variation of the filling material a complex retrofitting of the machine 1 is required. In these known systems, the cup 2" is lifted in the lifting direction H and during the filling process is lowered synchronously with the filled-in product flow A, B. By means of movements H' and S' that must be controlled additionally in the area of the supply openings of the filling nozzles 7 their opening position and closing position is controlled by tilting or sliding parts in the filling nozzles 7 while the position of the filling nozzle 7 itself is unchanged relative to the conveying plane E.

The machine 1 (FIGS. 2 through 6) further developed in accordance with the invention is characterized in that the movement possibilities, respectively, are now provided in the area of the filling nozzles 7 and these filling nozzles 7 cooperate as an extended functional module of the machine 1 with a programmable control unit 8. According to this concept, it is provided that only a direct tilting and/or lifting movement S' and H" of the metering module 6 is utilized and, in combination therewith, the conveyed product flows A, B, C or A', B', C' in accordance with the predetermined movement pattern and filling sequences are controlled by the control unit 8 (FIG. 2 through FIG. 5). With an appropriate creatively designed programming of the control unit 8 with variable filling processes a variety of variable filling structures can be generated in the cups 2'.

The phases that are shown in the drawings when using the machine 1 illustrate that the cups 2 that are moved in a timed sequence in the conveying plane E to the metering stations 3, 3', 3" can be filled with the different product flows A, B, C. The inventive integration of the control unit 8 into the machine concept enables variable filling structures (see the detail illustrations of cups 2" in FIGS. 2*a*, 2*b*; 3*a*, 3*b*; 4*a*, 4*b*; 5*a*) advantageously by means of a computer 11 correlated with the control unit wherein the computer 11 can be matched or adapted to the prior art machine 1 with minimal expenditure.

By means of changeable program data of the computer 11 in the area of the control unit 8 it is only required to preset the open positions of product channels of the filling nozzles 7 for the product supply, respectively, wherein at the same time appropriate movements in the area of the metering module 6 (lifting movement H', tilting movement S) are controlled precisely with regard to stroke and volume in accordance with the selected product structure. Because of the temporal sequence of the movements H' and S and their superposition with the product flows A, A', B, B', and/or C, C' (that are controllable by generally known prior art opening movements H and S' of the nozzles 7), a visually pleasing distribution of different products in the cups 2" is achieved.

Figures 2, 2A, 2B:
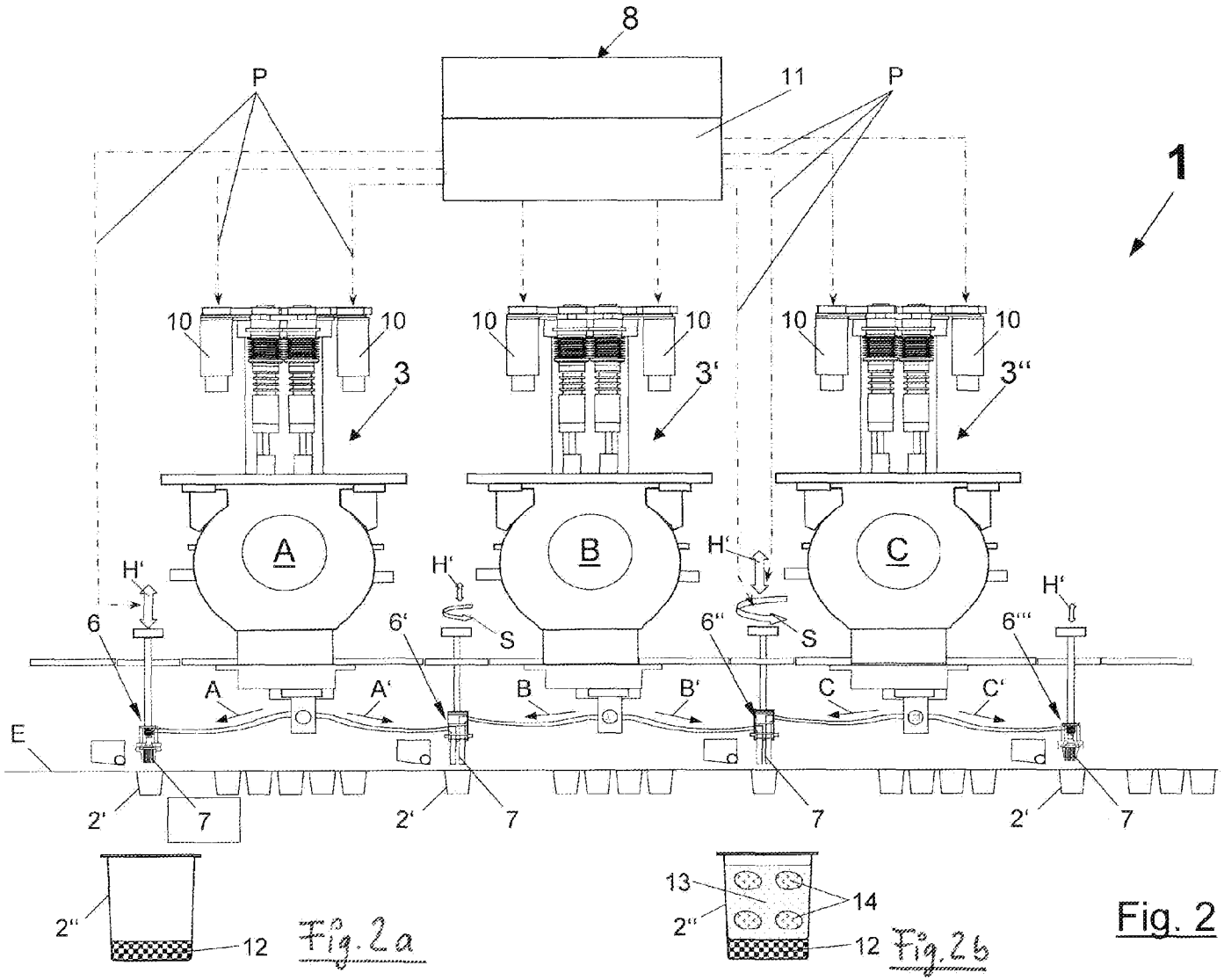
FIG. 2 is a first embodiment of a machine according to the invention with several metering stations for a first type of filling structure of the cups (shown in FIGS. 2*a* and 2*b*), wherein the machine is connected to a central control computer.

By means of the illustrated succession of preferably three metering stations 3, 3', 3", several product flows can be sequentially introduced into a cup 2, and, when doing so, by the movement sequences that are selectable by means of the program of the computer 11 the different filling structures can be created according to different patterns; this is illustrated by means of the cups 2", respectively (FIGS. 2*a*, 2*b*; 3*a*, 3*b*; 4*a*, 4*b*; 5*a*).

This control of the filling process is optimized such that on the machine 1 without interruption of the filling process the cups 2, supplied sequentially or parallel, can be filled with changing filling structures. In this connection, mechanical adjustments of movement modules and/or mounting of additional movement modules in the area of the cup support is not required. Also, it is conceivable that during operation of the machine 1 the control unit 8 can be adjusted to a new filling structure variant by changing program data in the computer 11 so that in this way an interruption-free filling process is possible.

In the illustrated embodiments, the control unit 8 that affects the filling structure is connected to three metering stations 3, 3', 3" wherein at least four metering modules 6, 6', 6", 6'" and their filling heads or filling nozzles 7, respectively, are connected in pairs sequentially to form a row. In the illustrations according to FIGS. 2 through 5, the signal lines (electric, radio or the like) provided for movement control are illustrated by dash-dotted lines P; they illustrate the control action in accordance with the provided control sequence without there being a need to explain these lines P in detail.

In the filling method according to FIG. 2, a product portion 12 moved in accordance with product flow arrow A is introduced into the cup 2" (illustrated enlarged beneath the conveying plane E; see FIG. 2*a*). The movable filling nozzle 7 is opened in lifting direction H' in the area of the inner conveying channels and, subsequently, the product portion 12 can be forced into the cup 2" with precise volume by the metering station 3 (with product A) by means of product supply devices (filling drives) 10 configured as servo motors. It is not required in this connection to lift or lower in the lifting direction H of the prior art (FIG. 1) the cup 2' supplied in the plane E by means of a drive (not illustrated).

After the first filling phase (partial filling 12), the cup 2" is transported father in the advancing plane E in a timed fashion and reaches the area of the metering module 6". In the example of a filling structure according to FIG. 2, the respective filling position is affected by a rotational movement S and lifting movement H' in the area of the respective filling nozzle 7 in such a way that, on top of the product portion 12, a product portion 13 is filled in from the metering station 3' (product B), respectively, and only thereafter the product portion 14 from metering station 3" is filled in therebetween as a dot pattern (see FIG. 2*b*) in accordance with the controlled sequence. In this connection it is no longer required to lift the cup by means of a complex drive (arrow H, FIG. 1) because the filling structure is created solely by means of the height-adjustable metering module 6". In addition to the movement control H', S, the respective filling drives 10 are controlled in accordance with the program sequence wherein it is provided in particular that only the movements H' and S are utilized.

It is conceivable in this connection that the movements H' and S are carried out simultaneously at predetermined speed. It is also conceivable that one group of cups 2, respectively, is filled and the metering modules 6' and 6" are utilized also (control connections are not illustrated).

Figures 3, 3A, 3B:
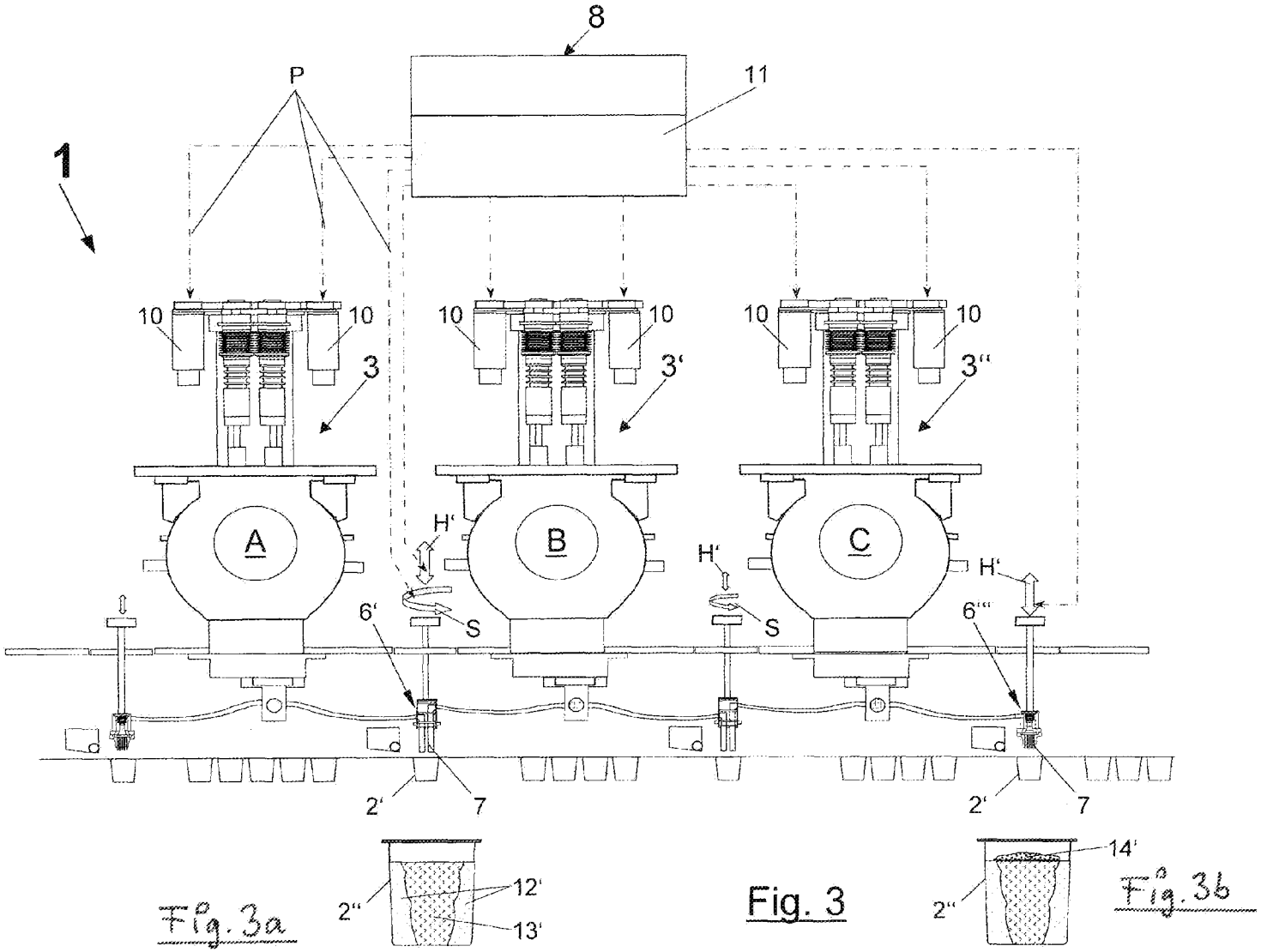
FIG. 3 is a second embodiment of a machine according to the invention with several metering stations for a second type of filling structure of the cups (shown in FIGS. 3*a* and 3*b*), wherein the machine is connected to a central control computer.

In FIG. 3, a second variant for creating a filling structure in the cup 2" is illustrated wherein with appropriate dash-dotted arrows the control connections with the computer 11 of the machine 1 similar to FIG. 2 are illustrated. As shown, filling is done with product portions 12" and 13' by means of metering stations 3, 3' and 3" wherein the products 12" and 13' are introduced at the same time by lifting (or lowering) of the filling nozzles 7 in the area of the metering modules 6' (FIG. 3*a*). After timed transport of the cup 2', the cup 2" is provided in the area of the metering module 6"' with additional product portion 14' (see FIG. 3*b*) wherein this product portion 14' is conveyed out of the metering station 3" in that its filling drive 10 becomes active.

Figures 4, 4A, 4B:
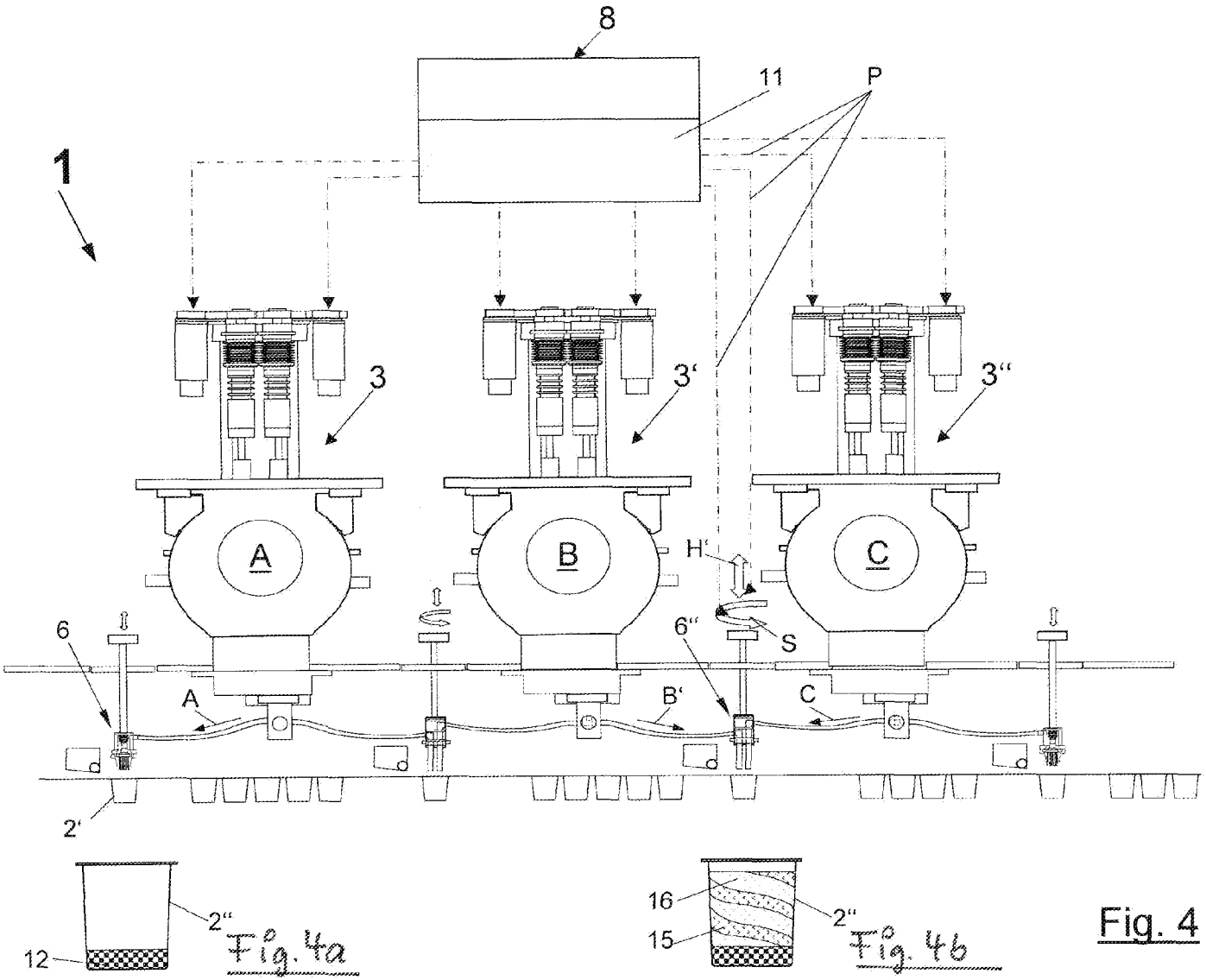
FIG. 4 is a third embodiment of a machine according to the invention with several metering stations for a third type of filling structure of the cups (shown in FIGS. 4*a* and 4*b*), wherein the machine is connected to a central control computer.

In FIG. 4, in an analog illustration to the afore described embodiments the creation of a spiral filling structure with product portions 15 and 16 is illustrated. In a first method step (similar to FIG. 2*a*), a product portion 12 is filled into the cup 2' as a base (see FIG. 4*a*) and, subsequently, in the area of the metering module 6" the two spirally shaped filling structures 15, 16 are generated wherein the products B' and C are simultaneously supplied and the illustrated movements H' and S are initiated. The result in shown in FIG. 4*b*. In this way, it becomes apparent that already by this tilting and lifting action of the filling nozzles 7 a variety of different filling structures can be created. The generally known cup movement H could be integrated additionally, if needed, in the filling system or the control program (not illustrated).

Figure 5:
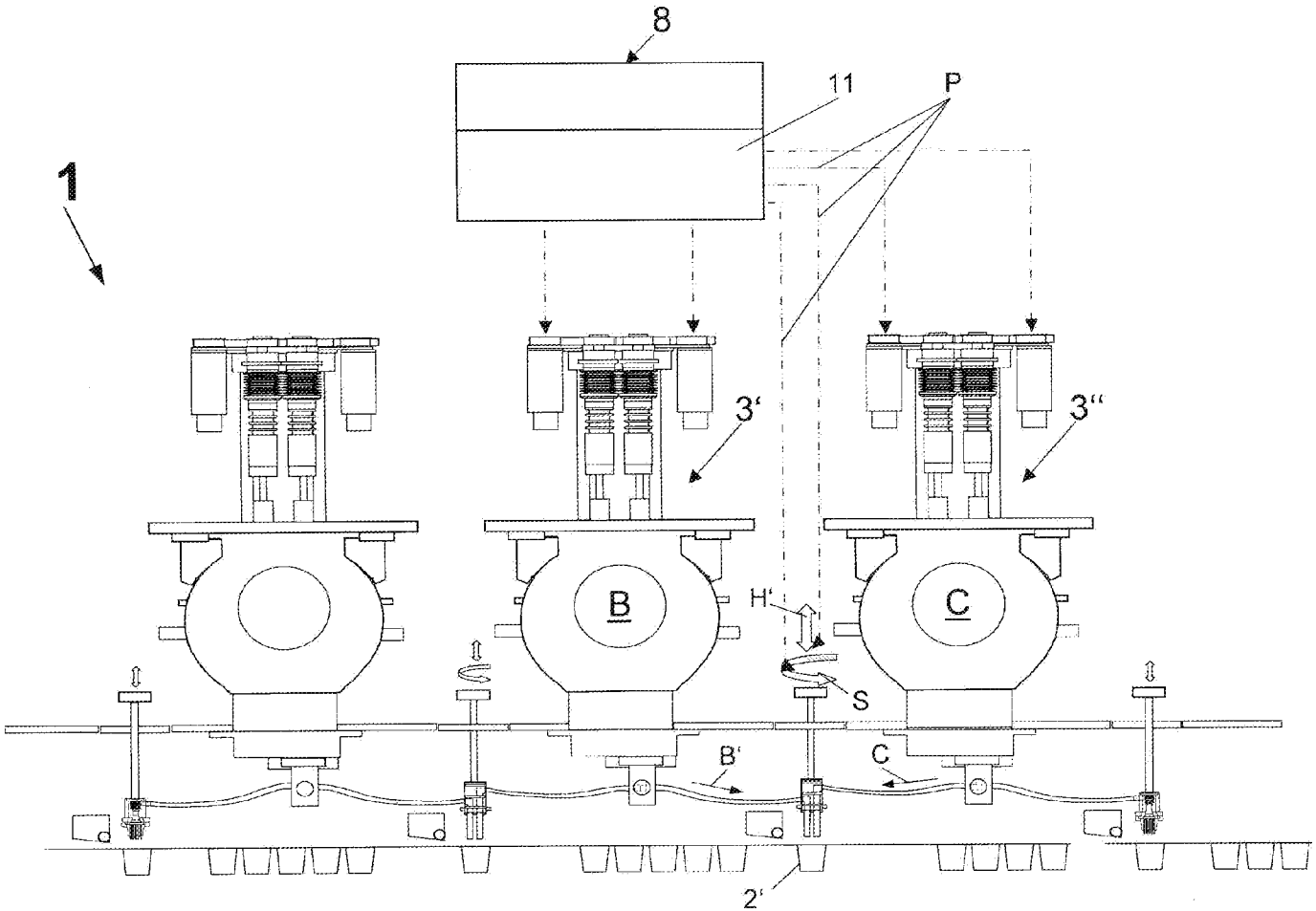
FIG. 5 is a fourth embodiment of a machine according to the invention with several metering stations for a fourth type of filling structure of the cups (shown in FIG. 5*a*), wherein the machine is connected to a central control computer.
Figure 5A:
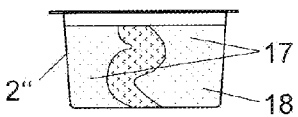

In the filling structure creation according to FIG. 5, only the metering stations 3' and 3" are used for introduction of the two product portions 17 and 18 wherein in the pre-filled product portions 17 subsequently or simultaneously spirally shaped course of the product portion 18 is generated (FIG. 5*a*).

Figure 6:
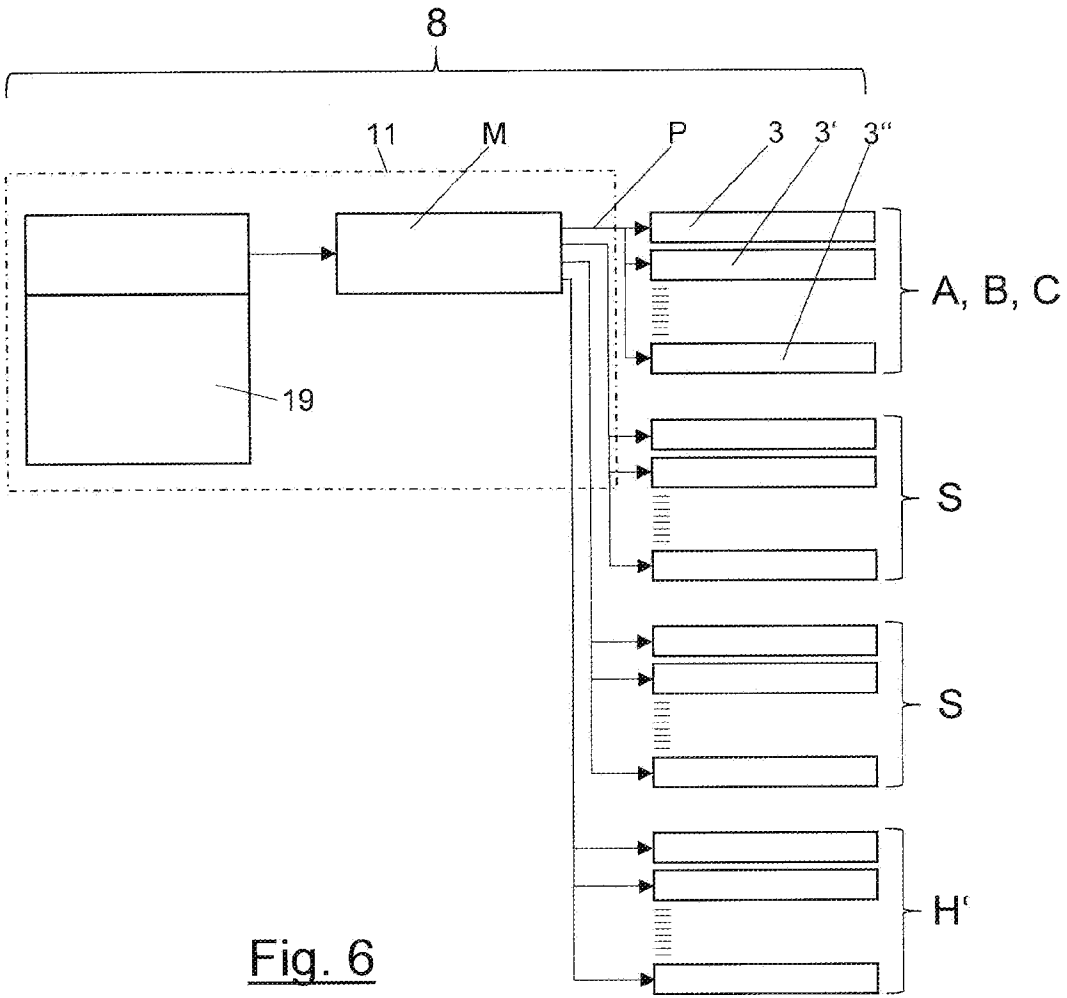
FIG. 6 is a schematic illustration of a movement pattern of the filling process carried out by means of the control unit and the computer program.

In FIG. 6 an overview of the control unit 8 is illustrated wherein from the program M by means of a selection part 19 a predetermined filling variant is selected and, by doing so, through control lines P corresponding signals are supplied to the filling drives 10 of the metering stations 3, 3', 3" and rotational movements S and/or the dropping movements H' are triggered so that the predetermined temporal sequence of cup filling action with decorative filling structure is effected.

The specification incorporates by reference the entire disclosure of German priority document 10 2006 015 638.2 having a filing date of Apr. 4, 2006.

While specific embodiments of the invention have been shown and described in detail to illustrate the inventive principles, it will be understood that the invention may be embodied otherwise without departing from such principles.

What is claimed is:

1. A machine for filling cups with foodstuff, the machine comprising:

metering stations having metering modules provided with filling nozzles, respectively, for introducing at least two different product flows each consisting of a different product into horizontally supplied cups, respectively, wherein the metering stations and the filling nozzle are arranged such that between two of the metering stations that each contain one of the different products, a common one of the filling nozzles is arranged that supplies the at least two different product flows, respectively;

a programmable control unit cooperating with the metering modules in such a way that in a filling process, by means of controlled rotating and lifting actions of the filling nozzles, variable filling structures are generated from the at least two different product flows in the cups.

2. The machine according to claim 1, wherein several of the metering stations receive cups in a timed sequence and the at least two different product flows, respectively, are introduced at the metering stations into the momentarily stationary cups.

3. The machine according to claim 1, further comprising a computer connected to the control unit, wherein the variable filling structures are affected by the computer correlated with the control unit.

4. The machine according to claim 3, wherein product supply devices and/or filling nozzle movements correlated with at least one of the metering modules are controlled by means of changeable program data of the computer.

5. The machine according to claim 1, wherein at the metering stations the at least two different product flows are sequentially introduced into a cup and the variable filling structures are generated from the at least two different product flows by predetermined program data, respectively.

6. The machine according to claim 1, wherein the horizontally supplied cups are supplied sequentially or parallel and are filled with the at least two different product flows to provide changing filling structures without interruption of the filling process.

7. The machine according to claim 3, wherein during operation of the machine the control unit is programmable by changeable program data in the computer.

8. The machine according to claim 1, wherein the control unit is connected to a first, a second and a third one of the metering stations arranged in a row and wherein at least four of the filling nozzles of the metering modules are provided, wherein of said at least four filling nozzles two are arranged between said first and second metering stations and said second and third metering stations respectively, and one is arranged in front of said first metering station and one is arranged behind said third metering station, wherein said at least four filling nozzles are connected by supply lines to form a row and are controlled by the control unit.

* * * * *